US007506928B1

(12) United States Patent
Meek et al.

(10) Patent No.: US 7,506,928 B1
(45) **Date of Patent: *Mar. 24, 2009**

(54) DISPOSABLE CHAIR COVER AND METHOD OF USING

(75) Inventors: Rhonda Meek, Cedar Rapids, IA (US); Mary Finch, Cedar Rapids, IA (US)

(73) Assignee: Marylegs Corp., Cedar Rapids, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/121,866

(22) Filed: May 16, 2008

Related U.S. Application Data

(63) Continuation of application No. 11/761,652, filed on Jun. 12, 2007, now Pat. No. 7,387,335.

(60) Provisional application No. 60/813,054, filed on Jun. 13, 2006.

(51) Int. Cl.
*A47C 31/11* (2006.01)
*G09F 3/00* (2006.01)

(52) U.S. Cl. ..... 297/229; 40/320

(58) Field of Classification Search ..... 297/229, 297/228.1, 225, 219.1, 218.1; 40/320; 428/57
See application file for complete search history.

(56) References Cited

U.S. PATENT DOCUMENTS

| | | | | |
|---|---|---|---|---|
| D104,187 | S | 4/1937 | Fry | |
| 3,916,447 | A | 11/1975 | Thompson | |
| 4,676,376 | A | 6/1987 | Keiswetter | |
| D303,473 | S | 9/1989 | Sheinman | |
| D307,995 | S | 5/1990 | Kelldorf | |
| D331,521 | S | 12/1992 | Kelldorf | |
| 5,419,945 | A | 5/1995 | Lopez | |
| 5,462,103 | A | 10/1995 | Effa | |
| 5,506,019 | A | 4/1996 | Abeyta et al. | |
| 5,707,107 | A | 1/1998 | Melone | |
| 6,481,736 | B1 | 11/2002 | Chan | |
| 6,484,328 | B1 | 11/2002 | Frazier | |
| 6,761,404 | B2 | 7/2004 | Parker et al. | |
| 6,805,048 | B2 | 10/2004 | Pearson et al. | |
| 7,011,365 | B2 | 3/2006 | Kerfoot et al. | |
| 7,080,883 | B1 | 7/2006 | Custer | |
| 7,350,861 | B2 * | 4/2008 | Zaharakos | 297/228.1 |
| 2004/0262964 | A1 | 12/2004 | Ryan | |

OTHER PUBLICATIONS

Shimmy Chair Cover, Disposable Chair Covers, www.shimmychaircovers.com, Camperdown, NSW, Australia.

* cited by examiner

*Primary Examiner*—Milton Nelson, Jr.
(74) *Attorney, Agent, or Firm*—Ryan N. Carter

(57) ABSTRACT

A disposable chair cover having an open end and a sealed end. The open end is adapted to receive at least a portion of a chair to cover and protect the chair. The chair cover comprises a decorative member, such as a bow, that can be combined with a portion of a chair. In one embodiment, a plurality of chair covers are packaged so that the plurality of chair covers are combined together on a roll and separated by first perforations. The first perforations can be easily separated by cutting or tearing as the roll is unwound. In addition to the first perforations, the roll of chair covers comprises a plurality of second perforations that separate each chair cover from its respective decorative member so that the chair covers and decorative members are packaged together on the same roll.

10 Claims, 2 Drawing Sheets

DISPOSABLE CHAIR COVER AND METHOD OF USING

CROSS REFERENCES TO RELATED APPLICATIONS

This application is a continuation of U.S. patent application Ser. No. 11/761,652 filed Jun. 12, 2007 now U.S. Pat. No. 7,387,335 issued on Jun. 17, 2008, which claims priority to, and the benefit of, U.S. Provisional Application Ser. No. 60/813,054 filed Jun. 13, 2006, both of which are hereby incorporated by reference.

BACKGROUND OF THE INVENTION

This invention relates generally to removable and disposable chair covers.

Recently, there has been a significant increase in the popularity of removable chair covers. These removable chair covers are generally used for functions and events (e.g., wedding receptions, conventions, holiday gatherings) where it is desirable to have chairs which look clean and uniform. The removable chair covers therefore are able to hide non-uniform or worn chairs from the view of patrons at the function or event. Another advantage of the removable chair cover is that the chair itself is protected from wear and tear.

There are several different types of existing removable chair covers. One type of existing cover is made of a woven fabric that is cut and stitched together so as to fit a standard type of chair. Generally, the cover, when fitted to a chair, is tied down using one of a variety of available tying methods. One problem with woven fabric chair covers is that they are becoming more expensive to manufacture as general costs of materials and manufacture increase. Accordingly, in order for the existing woven fabric removable chair covers to be a profitable item for a rental company or a meeting place such as a hotel ballroom, it is necessary for the removable chair cover to be reused. Reuse requires the added expense of washing (usually dry cleaning), repair, storage and other related costs (e.g., the cost of the post-function pick-up of the covers). Those manufacturing and reuse costs in a relatively competitive market have pushed down the profitability of these types of woven fabric chair covers. Another problem with woven fabric chair covers is that they are typically made to fit only one particular style of chair. This is especially a problem when a single venue has multiple styles or sizes of chairs that all require covering.

Another type of existing chair covers is made of non-woven paper. An example of this type of cover is disclosed in U.S. patent application Ser. No. 10/786,724 (Ryan). One problem with this type of chair cover is that many restaurants and reception halls do not allow patrons to decorate with colored paper due to its potential for staining and its potential fire hazard. Another problem with this type of cover is that the paper material may not be waterproof, so spilled drinks may penetrate the cover and damage the chair.

Yet another problem with both types of chair covers described above is that their packaging is inefficient, which leads to a higher cost for the consumer. The cloth type covers described above are often individually packaged which leads to a higher packaging cost. If a consumer needs several hundred chair covers, the increased packaging cost related to purchasing each chair cover individually is extremely significant. The chair cover described in U.S. patent application Ser. No. 10/786,724 is also inefficiently packaged because the decorative member (shown in FIG. 5*f* and FIG. 5*g* of that published application) is not packaged with the chair cover.

The separate packaging of the decorative member is inefficient and increases the cost to the end consumer.

There is therefore a need for a chair cover that is inexpensive to manufacture, efficiently packaged, and easy to use.

SUMMARY OF THE INVENTION

The present invention comprises a disposable chair cover having an open end and a sealed end. The open end is adapted to receive at least a portion of a chair to cover and protect the chair. The chair cover may comprise a decorative member, such as a bow, that can be combined with a portion of a chair.

In one embodiment, a plurality of chair covers are packaged so that the plurality of chair covers are combined together on a roll and separated by first perforations. The first perforations can be easily separated by cutting or tearing as the roll is unwound. In addition to the first perforations, the roll of chair covers comprises a plurality of second perforations that separate each chair cover from its respective decorative member so that the chair covers and decorative members are packaged together on the same roll. The roll packaging allows the plurality of chair covers to be easily shipped and stored without creasing or damaging the chair covers.

The invention also comprises a method of using a disposable chair cover. First a chair cover and decorative member are separated from the roll of chair covers by cutting or tearing their respective perforations. The open end of the chair cover is then placed over a portion of a chair. Excess chair cover material is tucked into the opening in the chair back. The decorative member is then combined with the chair.

DETAILED DESCRIPTION OF THE INVENTION

Figure 1:
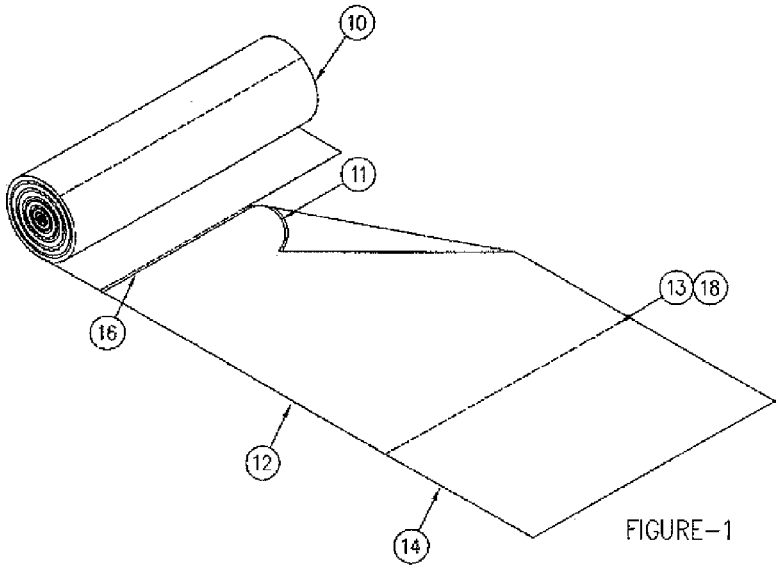
FIG. 1 is a perspective view of an embodiment of the invention showing a roll of chair covers with one chair cover unrolled exposing a partially torn first perforation for separating adjacent chair covers.
Figure 2:
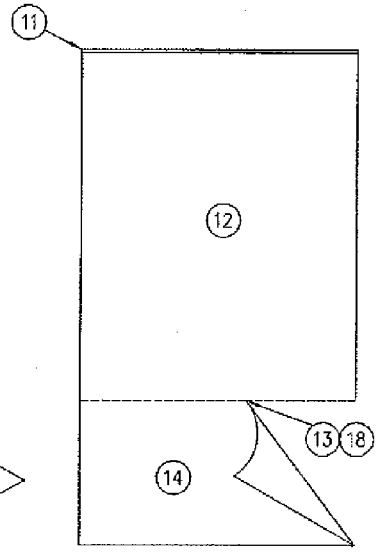
FIG. 2 is a top view of an embodiment of the invention showing a chair cover having a partially torn second perforation for separating the chair cover from its decorative member.
Figure 3:
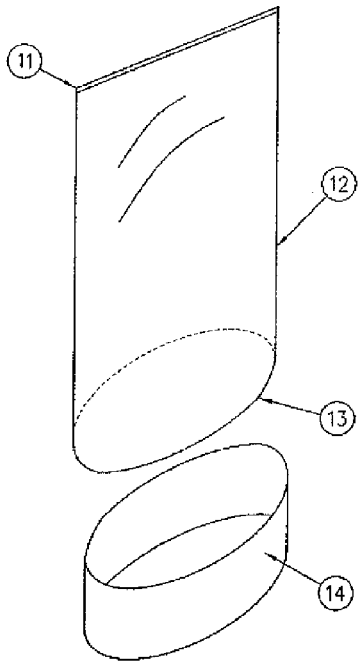
FIG. 3 is a perspective view of an embodiment of the invention wherein the chair cover has been separated from its decorative member at the second perforation.
Figure 4:
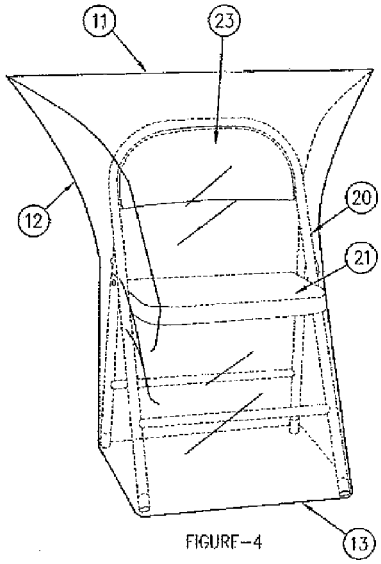
FIG. 4 is a front perspective view of an embodiment of the invention showing the chair cover placed over a chair.
Figure 5:
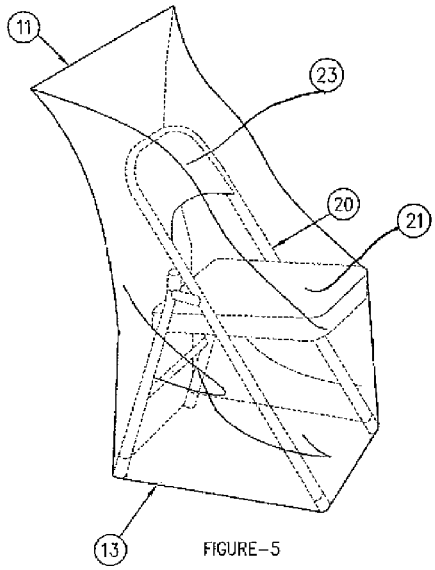
FIG. 5 is a side perspective view of an embodiment of the invention showing the chair cover placed over a chair.
Figure 6:
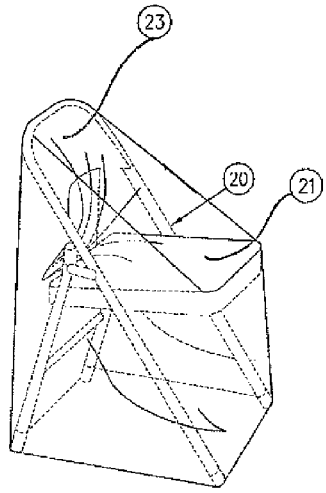
FIG. 6 is a side perspective view of an embodiment of the invention showing how the excess chair cover material is tucked into the opening between the chair seat and the chair back.
Figure 7:
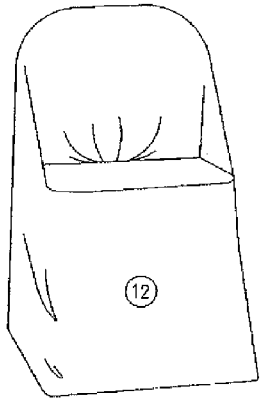
FIG. 7 is a front perspective view of an embodiment of the invention showing how the excess chair cover material is tucked into the opening between the chair seat and the chair back.

As seen in FIGS. 1-3, the present invention comprises a disposable chair cover 12 having a first (open) end 13 and a second (sealed) end 11. As seen in FIGS. 4-6, the open end 13 is adapted to receive at least a portion of a chair 20 to cover and protect the chair 20. Disposable chair cover 12 is suitable for use with a standard function room chair, for example, a no-armed chair 20 with a back 23, a seat 21, and four legs. The chair covers 12 can be various sizes, but are preferably large enough to cover a standard sized armless chair 20 down to the floor with some excess chair cover 12 material left over.

Figure 9:
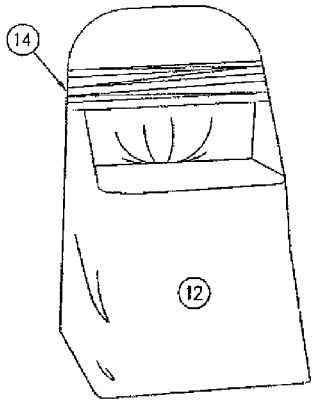
FIG. 9 is similar to FIG. 7 but showing a decorative member combined with the chair back.
Figure 10:
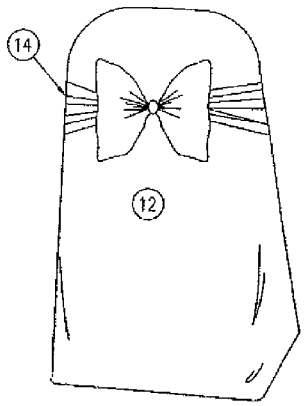
FIG. 10 is a rear view of FIG. 9.

As shown in FIGS. 9 and 10, a decorative member 14, such as a bow or sash, may be combined with a portion of the chair 20 to enhance the aesthetic appearance of the chair 20 and chair cover 12. The decorative member 14 also serves to help secure the chair cover 12 to the chair 20 by drawing loose folds of the chair cover 12 tightly against the chair back 23. This helps the chair cover 12 conform to different shaped chair backs, 23 including chair backs 23 that are square, round, wide, or narrow.

In the embodiment shown in FIG. 1, a plurality of chair covers 12 are packaged so that the plurality of chair covers 12 are combined together on a roll 10 and separated by first perforations 16. FIG. 1 shows a chair cover 12 being torn along the first perforation 16 to separate a single chair cover 12 from the roll 10 of chair covers 12.

As seen in FIG. 1, the roll 10 of chair covers 12 further comprises a second perforation 18 that separates each individual chair cover 12 from its respective decorative member 14. In this manner, the chair cover 12 and decorative members 14 can be packaged together on the same roll 10. FIG. 2 shows a single chair cover 12 separated from the roll 10 of chair covers 12 wherein the decorative member 14 is being torn along the second perforation 18 to separate the chair cover 12 from its decorative member 14. FIG. 3 shows the decorative member 14 separated from its chair cover 12.

In one embodiment the perforations 16, 18 are a series of pierced openings that aid the user in tearing and separating the chair covers 12 and/or decorative members from the roll 10 by weakening the structural integrity of the roll 10 at the point of the perforation 16,18. In an alternate embodiment, the perforations 16, 18 are a dotted line or other suitable mark that does not weaken the roll 10, but instead indicates to the user where to cut (using scissors or a knife) to separate the chair covers 12 and/or decorative members from the roll 10.

In one embodiment, the chair covers 12 are comprised of a plastic polymer material. The plastic polymer material allows the covers 12 to be manufactured in different colors. In some embodiments, the plastic polymer chair cover 12 material may be printed with names, logos, and/or holographic images to customize and personalize their appearance. The plastic polymer material is waterproof, which provides protection to the chair 20 in the event of spilled food or beverage. Further, the plastic polymer material allows the chair covers 12 to be removed from the chairs 20 and function as garbage bags after the event has concluded. In other embodiments, the chair covers 12 may be comprised of paper, other types of plastic, or any other suitable material.

Figure 8:
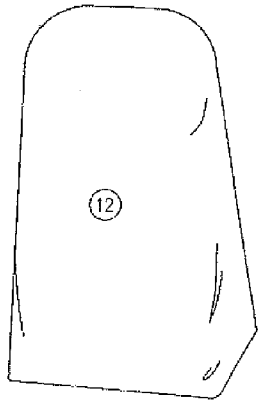
FIG. 8 is a rear view of FIG. 7.

FIGS. 4-10 illustrate a preferred method of using the disposable chair cover 12 described above. As shown in FIGS. 1 and 2, the first step is to remove a chair cover 12 from the roll 10 by tearing or cutting along first perforation 16 and then separating the decorative member 14 from its chair cover 12 by tearing or cutting along second perforation 18. As seen in FIGS. 4 and 5, after the chair cover 12 and decorative member 14 are separated from the roll 10, the open end 13 of a chair cover 12 is placed over a chair 20 until a portion of the cover 12 touches the floor. FIGS. 4 and 5 show that the chair cover 12 preferably comprises some excess material that allows the chair cover 12 to fit different sized chairs 20. As shown by the arrow in FIG. 6, the excess material is tucked behind the chair's 20 seat into the opening between the chair's seat 21 and the chair's back 23. Tucking the excess chair cover 12 material in this manner helps to prevent the chair cover 12 from shifting when a user is sitting on it. Further, tucking the excess chair cover 12 in this manner hides the excess material since it is not visible from the back of the chair as shown in FIG. 8. After the excess material is tucked away, the decorative member 14 may be combined with the chair 20 to add to the aesthetic appeal of the chair cover 12 and help secure the chair cover 12 to the chair 20 as shown in FIGS. 9 and 10. It should be noted that the decorative member 14 may be combined with the chair 20 in any of a number of configurations, and that the invention is not limited to the bow configuration shown in FIG. 10.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is as follows:

1. A disposable chair cover adapted to cover and protect a chair, said chair cover comprising:

an open end adapted to receive at least a portion of the chair;

a sealed end opposite the open end;

a decorative member combined with the chair cover;

a perforation separating the chair cover from the decorative member.

2. The disposable chair cover of claim 1 wherein the perforation is a series of pierced openings that aid in separating the chair cover from the decorative member by weakening the structural integrity of the chair cover at the perforation.

3. The disposable chair cover of claim 1 wherein the perforation is a mark that indicates where the chair cover should be cut to separate the chair cover from the decorative member.

4. The disposable chair cover of claim 1 wherein a plurality of said chair covers and decorative members are combined on a roll.

5. The disposable chair cover of claim 4 wherein a first said chair cover and its decorative member are separated from a second said chair cover and its decorative member by a second perforation.

6. The disposable chair cover of claim 5 wherein the second perforation is a series of pierced openings that aid in separating the first said chair cover and its decorative member from the second said chair cover and its decorative member by weakening the structural integrity of the roll at the second perforation.

7. The disposable chair cover of claim 5 wherein the second perforation is a mark that indicates where the roll should be cut to separate the first said chair cover and its decorative member from the second said chair cover and its decorative member.

8. The disposable chair cover of claim 1 wherein the chair cover is comprised of a plastic polymer material.

9. A disposable chair cover adapted to cover and protect a chair, said chair cover comprising:

an open end adapted to receive at least a portion of the chair;

a sealed end opposite the open end;

a decorative member combined with the chair cover;

a perforation separating the chair cover from the decorative member;

wherein the decorative member is adapted to be combined with a portion of the chair when it is separated from the chair cover.

10. A method of forming a cover to a chair having a seat, a back, and an area between the seat and the back, wherein a plurality of chair covers are packaged on a roll and each individual chair cover comprises a decorative member, an open end, and a sealed end, said method comprising:

separating the chair cover and its decorative member from the plurality of chair covers;

separating the decorative member from the chair cover;

placing the open end of the chair cover over the top of a chair;

gathering excess chair cover material and stuffing it into the area between the chair seat and the chair back;

securing the decorative member to the chair back.

* * * * *